United States Patent [19]

Niimi et al.

[11] 4,267,077

[45] May 12, 1981

[54] DETERGENT COMPOSITION FOR DRY CLEANING

[75] Inventors: Yukihisa Niimi, Sakura; Katsumi Saegusa, Funabashi, both of Japan

[73] Assignee: Kao Soap Co., Ltd., Tokyo, Japan

[21] Appl. No.: 11,753

[22] Filed: Feb. 12, 1979

[30] Foreign Application Priority Data

Feb. 15, 1978 [JP] Japan ..... 53-16318

[51] Int. Cl.[3] ..... C11D 1/65; C11D 7/28; C11D 7/50

[52] U.S. Cl. ..... 252/545; 252/8.75; 252/8.8; 252/153; 252/547; 252/548; 252/550; 252/551; 252/558

[58] Field of Search ..... 252/8.75, 8.8, 153, 252/545, 547, 558; 8/142

[56] References Cited

U.S. PATENT DOCUMENTS

| | | | |
|---|---|---|---|
| 2,820,719 | 1/1958 | Trusler et al. | 8/142 |
| 2,980,624 | 4/1961 | Miller | 252/153 X |
| 3,222,286 | 12/1965 | Barnes | 252/171 X |
| 3,238,011 | 3/1966 | Lawrence et al. | 8/142 |
| 3,642,644 | 2/1972 | Grote et al. | 252/153 |
| 3,707,508 | 12/1972 | Blomfield | 252/162 |
| 3,715,186 | 2/1973 | Anninos | 8/142 |
| 3,827,857 | 8/1974 | Boulus | 8/137 |
| 3,859,225 | 1/1975 | McKnight | 252/153 |
| 4,000,077 | 12/1976 | Wixon | 252/8.75 |
| 4,102,824 | 7/1978 | Mizutani et al. | 252/545 |
| 4,144,177 | 3/1979 | Minegishi et al. | 252/8.8 |

FOREIGN PATENT DOCUMENTS

| | | | |
|---|---|---|---|
| 2449501 | 4/1975 | Fed. Rep. of Germany | 252/547 |
| 2642398 | 3/1977 | Fed. Rep. of Germany | 252/171 |
| 49-57008 | 6/1974 | Japan | 252/106 |
| 52-5809 | 1/1977 | Japan | 252/547 |
| 912489 | 12/1962 | United Kingdom | 134/40 |
| 1301909 | 1/1973 | United Kingdom . | |

*Primary Examiner*—P. E. Willis, Jr.

*Attorney, Agent, or Firm*—Blanchard, Flynn, Thiel, Boutell & Tanis

[57] ABSTRACT

The disclosed detergent composition is suited to dry cleaning with high washing power and provides treated clothing with high softening and antistatic effects, the detergent composition comprises a quaternary ammonium salt, an alkanolamine salt of an anionic surfactant and a solvent.

10 Claims, No Drawings

DETERGENT COMPOSITION FOR DRY CLEANING

The present invention relates to a detergent composition for dry cleaning which exerts an excellent washing power and imparts high softening and antistatic effects to clothing during the dry cleaning step. More particularly, the invention relates to a detergent composition for dry cleaning comprising a quaternary ammonium salt, an anionic surfactant and a dry cleaning solvent.

In the dry cleaning process using halogenated hydrocarbon solvents such as tetrachloroethylene, trichloroethylene, trichloroethane and trichlorotrifluoroethane and solvents of the petroleum type such as paraffin, naphthene and aromatic hydrocarbons, various activators are used for removing water-soluble stains and solid soils. Detergent compositions for dry cleaning usually comprise 5 to 80% by weight (all references to "%" given hereinafter are by weight) of a surface active agent, which is incorporated to facilitate use of the composition, and a dry cleaning solvent, a viscosity reducing agent and an anti-corrosive agent, and these detergent compositions are liquid. When such liquid composition is actually employed, it is diluted with a dry cleaning solvent at a ratio of 0.1 to 5% against the weight of the solvent. Accordingly, the properties of the liquid detergent composition have significant influences on the dry cleaning effects, and it is required that the liquid detergent composition should be homogeneous.

According to the conventional techniques, there have been developed detergent compositions for dry cleaning including various surfactants, for example, a mixture of an anionic surfactant and a non-ionic surfactant as disclosed in Japanese Patent Publication no. 31095/69, a mixture of a non-ionic surfactant and a cationic surfactant as disclosed in Japanese Patent Application Laid-Open Specification No. 94306/77, and other surfactants as disclosed in Japanese Patent Publications Nos. 1498/64, 21047/64 and 6974/67.

Recently, in order to meet the requirements of shortening and rationalizing the dry cleaning process, there has been developed a washing method in which various finishing treatments such as the softening treatment and the antistatic treatment are conducted simultaneously with the washing of clothing. Cationic surfactants used for finishing treatments are ordinarily high in crystallinity and when these cationic surfactants are used, homogeneous stable liquid detergent compositions are hardly obtained. Further, when these detergent compositions are diluted with dry cleaning solvents, the solubility is extremely poor. Although there has been proposed a method in which an electrically neutral non-ionic surfactant is used in combination with a cationic surfactant to improve the stability and homogeneousness of a cationic surfactant containing composition, this method is still insufficient in that the non-ionic surfactant should be incorporated in a large amount, resuting in a reduction of the softening and antistatic effects. Although a lower alcohol has an effect of stabilizing cationic surfactants, the use of such lower alcohol is not preferred because the lower alcohol must be used in a large amount and the risk of occurrence of accidents is high. Further, the solubility is very low when the composition is diluted with a dry cleaning solvent. Accordingly, it has been eagerly desired to develop a detergent composition which stably contains a cationic surfactant and which can be stably diluted with a dry cleaning solvent.

We have made researches with a view to developing such detergent composition for dry cleaning, and to our great surprise, it has been found that when a quaternary ammonium salt is mixed with an alkanolamine salt of an anionic surfactant, there can be obtained a detergent composition for dry cleaning which is homogeneous and stable and is excellent in its cleaning power, softening effect, antistatic effect and anti-corrosive effect. We have now completed the present invention based on this finding.

The cationic surfactant used in the present invention is a quaternary ammonium salt of the formula (1):

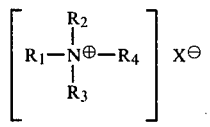

(1)

wherein $R_1$ is an alkyl group having 12 to 22 carbon atoms, $R_2$ and $R_3$, which are same or different, are an alkyl group having 1 to 3 carbon atoms or a group

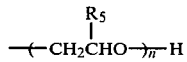

in which $R_5$ is hydrogen or methyl and n is an integer of from 1 to 3, $R_4$ is the same as $R_2$ or is an alkyl group having 12 to 22 carbon atoms, and X is a halogen or a monoalkyl sulfate group having 1 to 3 carbon atoms in the alkyl.

As typical examples of compounds of the formula (1), there can be mentioned palmityltrimethylammonium chloride, stearyltrimethylammonium chloride, stearyldimethylethylammonium ethylsulfate, stearyltrimethylammonium methylsulfate, dilauryldimethylammonium methylsulfate, distearyldimethylammonium chloride, behenyltrimethylammonium chloride, stearyldimethylhydroxyethylammonium methylsulfate, stearylmethyldihydroxyethylammonium chloride, lauryldimethylethylammonium ethylsulfate and mixtures thereof.

It is critical that the quaternary ammonium salt should be incorporated in an amount of 5 to 60% in the detergent composition for dry cleaning.

The anionic surfactant that is used in the present invention should contain a counter ion derived from an alkanolamine in order to prevent dry cleaning equipment from corrosion. For example, an alkali metal salt of an anionic surfactant is not suitable because it corrodes dry cleaning equipment vigorously. Further, this alkali metal salt precipitates at low temperatures, and therefore, a homogeneous stable liquid detergent composition cannot be obtained. Since a dry cleaning solvent is used repeatedly after distillation, if an alkanolamine having a low boiling point is used as the counter ion, it is incorporated into the dry cleaning solvent at the distillation step. Accordingly, when such alkanolamine-containing solvent is used, an unpleasant smell is readily left on clothing. Therefore, a count ion derived from an alkanolamine having a boiling point higher than 200° C. is preferred. As preferred alkanolamines, there can be mentioned diethanolamine, triethanolamine, dibutylethanolamine and methyldiethanolamine. As preferred anionic surfactant alkanolamine salts, there can be mentioned alkyl sulfate salts and polyoxyalkylene alkyl sulfate salts of the formula (2):

$$R_6O(CH_2\overset{\overset{R_5}{|}}{C}HO)_mSO_3M \quad (2)$$

wherein $R_6$ is an alkyl group having 10 to 20 carbon atoms, $R_5$ is hydrogen or methyl, m is a number of from 0 to 5, and M is an alkanolamine counter ion, and alkylaryl sulfonate salts of the formula (3):

$$r_7—Ar—SO_3M \quad (3)$$

wherein $R_7$ is an alkyl group having 8 to 20 carbon atoms, Ar is phenyl or naphthyl group, and M is an alkanolamine counter ion. Most preferred anionic surfactant alkanolamine salts include alkanolamine salts of alkylbenzene sulfonates, alkanolamine salts of alkyl sulfate and alkanolamine salts of polyoxyethylene (n=1 or 2) alkyl sulfate.

It is critical that the anionic surfactant alkanolamine salt should be incorporated in an amount of 1 to 50% in the detergent composition. It also is critical that a weight ratio of the anionic surfactant to the cationic surfactant should be 5 to 60%, preferably 10 to 40%. When the anionic surfactant is incorporated in too large an amount, drastic reduction of the washing power is caused. In contrast, when the amount of the anionic surfactant is too small, the cationic surfactant is not homogeneously incorporated and the quaternary ammonium salt as the cationic surfactant precipitates with the passing of time, and no good solubility is obtained when the detergent composition is diluted with a dry cleaning solvent.

In the present invention, the kind of the dry cleaning solvent is not particularly critical. There can be used, for example, tetrachloroethylene, trichloroethylene, trichloroethane, trifluorotrichloroethane, and so-called petroleum solvents comprising paraffin, naphthene and/or aromatic hydrocarbons and having a boiling point of 120° to 220° C.

In the present invention, components customarily incorporated in detergent compositions for dry cleaning may be used. For example, there may be used lower alcohols ($C_1$–$C_3$) such as methanol, ethanol and isopropanol, polyhydric alcohol ethers such as butyl cellosolve, and water. Further, a non-ionic surfactant or the like may be incorporated in such an amount as will have no bad influences on the detergent composition.

As will be apparent from the foregoing illustration, by mixing a quaternary ammonium salt with an anionic surfactant alkanolamine salt at a specific ratio and incorporating this mixture into a dry cleaning solvent, it is possible to obtain a detergent composition for dry cleaning which is stable and homogenous and has a good solubility in a dry cleaning solvent and which exerts high washing power, excellent softening effect, excellent antistatic effect and high anti-corrosive effect.

The present invention will now be described in detail by reference to the following Examples that by no means limit the scope of the invention.

EXAMPLE 1

The following compositions shown in Table 1 are prepared and tested.

TABLE 1

| | Present Invention | | Comparison | | | |
|---|---|---|---|---|---|---|
| Run No. | 1 | 2 | 3 | 4 | 5 | 6 |
| Composition (%) | | | | | | |
| stearyltrimethyl ammonium chloride | 15 | 15 | 15 | 15 | 15 | 15 |
| diethanolamine dodecyl benzene-sulfonate | 5 | 2 | 0.4 | | | |
| polyoxyethylene (3) nonylphenyl ether | | | | | 5 | 30 |
| isopropanol | | 5 | 5 | | | 5 |
| tetrachloroethylene | 80 | 78 | 80.6 | 85 | 80 | 50 |
| Stability on Dilution with Tetrachloroethylene | o | o | x | x | x | x |

Note

The tetrachloroethylene dilution stability is evaluated based on the liquid appearance observed when the detergent composition for dry cleaning is diluted with tetrachloroethylene so that the content of the quaternary ammonium salt is 0.1%.

o: homogeneous and transparent or bluish white liquid x: separation into two phases or formation of precipitates When only the quaternary ammonium salt, which is a cationic surfactant, is incorporated (Run No. 4), the solubility in the dry cleaning solvent is poor. When a non-ionic surfactant is used according to the conventional technique (Runs Nos. 5 and 6), a large amount of the surfactant must be used and precipitation takes place on dilution with the dry cleaning solvent. In contrast, a homogeneous and transparent liquid composition can be obtained according to the present invention (Runs Nos. 1 and 2).

No stable composition is obtained unless the quaternary ammonium salt is mixed with the anionic surfactant in such amounts that the mixing ratio of the anionic surfactant to the quaternary ammonium salt is at least 5%.

EXAMPLE 2

Detergent compositions are prepared by using various quaternary ammonium salts and anionic activators as shown in Table 2, and these compositions are tested.

TABLE 2

| | Present Invention | | | | | | | | Comparison |
|---|---|---|---|---|---|---|---|---|---|
| Run No. | 7 | 8 | 9 | 10 | 11 | 12 | 13 | 14 | 15 |
| Composition (%) | | | | | | | | | |
| stearyltrimethylammonium chloride | 20% | 20 | 20 | 30 | | | | | 15 |
| palmityldimethylethylammonium ethylsulfate | | | | | 10 | | 15 | 15 | |
| dilauryldimethylethylammonium methylsulfate | | | | | | 50 | | | |
| diethanolamine dodecyl benzene-sulfonate | 6 | 6 | | | 1 | 10 | | | |
| dibutylethanolamine dodecyl sulfate | | | 5 | 7 | | | 4 | | |

TABLE 2-continued

| Run No. | Present Invention 7 | 8 | 9 | 10 | 11 | 12 | 13 | 14 | Comparison 15 |
|---|---|---|---|---|---|---|---|---|---|
| diethanolamine polyoxyethylene (6) dodecyl sulfate | | | | | | | | | 8 |
| methyldiethanolamine polyoxyethylene (2) dodecyl sulfate | | | | | | | | 7 | |
| tetrachloroethylene | 74 | | 69 | | 84 | | 81 | 78 | 77 |
| petroleum solvent (New-Sol Deluxe manufactured by Nippon Sekiyu) | | 74 | | 61 | | 32 | | | |
| isopropanol | | | 5 | | 3 | 5 | | | |
| water | | | 2 | 2 | 2 | 3 | | | |
| Stability on Dilution with Tetrachloroethylene | o | o | o | o | o | o | o | o | x |

EXAMPLE 3

Softening and antistatic effects to wool serge and acryl jersey are tested according to the methods described below. Obtained results are shown in Table 3.

Preparation of Samples

A dry cleaning treatment liquid is prepared by diluting a detergent composition for dry cleaning with 1 l of tetrachloroethylene so that the concentration of the quaternary ammonium salt contained in the detergent composition may be 0.1%. Wool serge or acryl jersey fabric (5 g) is dipped in the liquid for 10 minutes and the fabric is centrifugally dehydrated by a centrifugal dehydrating machine so that the amount left of the dry cleaning treatment liquid is 20% based on the fabric. Then, the fabric is dried and allowed to stand in a thermostat chamber maintained at a temperature of 20° C. and a relative humidity of 65% for 24 hours. The so treated fabric is used as a sample.

Measurement of Softening Effect

The flexural rigidity is measured by using a bending tester (Model KES-F2 manufactured by Kato Tekkosho K.K.). More specifically, one end of a sample (2 cm×2.5 cm) is fixed and the other end is attached to a moving chuck. The moving chuck is moved and the bending moment (M) and curvature (K) are recorded by an X-Y recorder. The gradient (Bf) of a line approximating to the obtained M-X curve is determined. The front and back sides of the sample are reversed and the test is similarly conducted to obtain a gradient (Bb). The flexural rigidity (B) is calculated from the following formula:

$$B = \frac{(Bf + Bb)}{2}$$

A lower value of the flexural rigidity (B) indicates a better softness. Incidentally, a difference of about $3\times10^{-3}$ g.cm in the flexural rigidity can be detected on handling.

Measurement of Antistatic Effect

A sample (15 cm×15 cm) is inserted in a resistance value-measuring cell of a high resistance meter (manufactured by Yokokawa-Hewlett Packard K.K.), and the resistance is measured while applying a voltage of 100 V. The antistatic effect is evaluated based on the obtained resistance value.

TABLE 3

| Run No. | Present Invention 1 | 16 | 17 | 18 | Comparison 6 | 23 |
|---|---|---|---|---|---|---|
| Composition (%) | | | | | | |
| stearyltrimethylammonium chloride | 15 | 15 | | | 15 | |
| palmityldimethylhydroxyethylammonium methylsulfate | | | 15 | 15 | | 15 |
| dibutylethanolamine dodecyl sulfate | | 3 | | 3 | | |
| diethanolamine dodecylbenzene-sulfonate | 5 | | 5 | | | |
| polyoxyethylene (3) nonylphenyl ether | | 2 | | | 30 | 30 |
| tetrachloroethylene | 80 | 80 | 80 | 80 | 50 | 50 |
| isopropanol | | | | | 5 | |
| Flexural Rigidity ($10^{-3}$ g . cm) | | | | | | |
| wool serge | 128 | 131 | 129 | 130 | 138 | 137 |
| acryl jersey | 21 | 22 | 21 | 21 | 26 | 25 |
| Antistatic Effect ($10^8$ Ω) | | | | | | |
| wool serge | 5 | 6 | 6 | 5 | 11 | 11 |
| acryl jersey | 0.5 | 0.7 | 0.6 | 0.5 | 3.2 | 2.3 |

When a non-ionic activator is used in a large amount (Runs Nos. 6 and 23), the flexural rigidity value is large, and the touch or feel is poor as compared with the case where the composition of the present invention is used. Further, in this case, the resistance is high and the antistatic effect is low.

EXAMPLE 4

The washing test is carried out on detergent compositions for dry cleaning according to the following method to obtain results shown in Table 4.

Measurement of Washing Power

According to the method defined by the Japanese Society of Oil Chemistry (Handbook of Chemistry of Oils and Fats, page 720, published in 1971 by Maruzen K.K.), three contaminated cotton fabric samples are dipped in 1 l of a dry cleaning treatment liquid formed by diluting a detergent composition with tetrachloroethylene so that the concentration of a quaternary ammonium salt may be 0.1%. They are washed for 10 minutes in a Terg-O-Meter. The washing liquid is removed and the samples are dried. The reflectance is measured by a spectrophotometer and the washing ratio (D) is calculated according to the following formula:

$$D = \frac{\text{reflectance after washing} - \text{reflectance before washing}}{\text{reflectance of unsoiled cloth} - \text{reflectance before washing}} \times 100$$

TABLE 4

| Run No. | Present Invention 1 | Present Invention 19 | Comparison 20 | Comparison 21 |
|---|---|---|---|---|
| Composition (%) | | | | |
| stearyltrimethylammonium chloride | 15 | 15 | 15 | 15 |
| diethanolamine dodecyl benzene-sulfonate | 5 | 8 | 10 | 15 |
| tetrachloroethylene | 80 | 77 | 75 | 70 |
| Washing Ratio (D) (%) | 50 | 47 | 40 | 32 |

When the amount of the anionic activator alkanolamine salt is larger than 60% based on the quaternary ammonium salt (Run No. 20), the washing power is low and no good results are obtained.

EXAMPLE 5

The action of dry cleaning treatment liquids concerning corrosion on metal of a distiller is examined according to the following method to obtain results shown in Table 5.

Metal Corrosion Test

A 500 ml-capacity glass flask equipped with a cooler is charged with 180 ml of tetrachloroethylene, 60 ml of water and 60 ml of a detergent composition for dry cleaning, and copper and zinc pieces precisely weighed and placed into the liquid. The flask is heated on a silicone bath at 120° to 125° C. for 48 hours to determine the weight changes of the copper and zinc pieces.

TABLE 5

| Run No. | Present Invention 1 | Comparison 22 |
|---|---|---|
| Composition (%) | | |
| stearyltrimethylammonium chloride | 15 | 15 |
| potassium dodecyl benzene-sulfonate | | 5 |
| diethanolamine dodecyl benzene-sulfonate | 5 | |
| tetrachloroethylene | 80 | 80 |
| Weight Change (mg/cm$^2$) | | |
| copper | −0.12 | −0.51 |
| zinc | −6.30 | −23.53 |

What is claimed is:

1. A homogeneous, stable, liquid, detergent composition for dry cleaning consisting essentially of (A) 5 to 60% by weight of at least one quaternary ammonium salt of the formula (1):

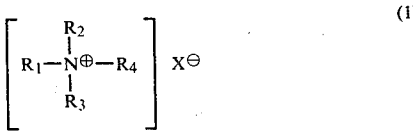

(1)

wherein $R_1$ is alkyl having 12 to 22 carbon atoms, $R_2$ and $R_3$, which are the same or different, each is alkyl having 1 to 3 carbon atoms or

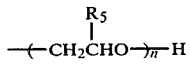

in which $R_5$ is hydrogen or methyl and n is an integer of from 1 to 3, $R_4$ is the same as $R_2$ or alkyl having 12 to 22 carbon atoms, and X is a halogen or monoalkyl sulfate group having 1 to 3 carbon atoms in the alkyl, (B) 1 to 50% by weight of at least one anionic surfactant alkanolamine salt selected from the group consisting of compounds of the formula

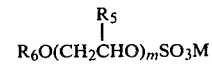

(2)

wherein $R_6$ is alkyl having 10 to 20 carbon atoms, $R_5$ is hydrogen or methyl, m is an integer of from 0 to 5, and M is an alkanolamine counter ion derived from an alkanolamine having a boiling point higher than 200° C., and compounds of the formula $$R_7—Ar—SO_3—M \quad (3)$$

wherein $R_7$ is alkyl having 8 to 20 carbon atoms, Ar is phenylene or naphthylene, and M is said alkanolamine counter ion, and (C) 5 to 80% by weight % of a dry cleaning solvent selected from the group consisting of tetrachloroethylene, trichloroethylene, trichloroethane, trifluorotrichloroethane and petroleum dry cleaning solvent, the weight ratio of component (A) to component (B) being in the range of from 100/5 to 100/60.

2. A detergent composition as claimed in claim 1 in which said quaternary ammonium salt is selected from the group consisting of palmityltrimethylammonium chloride, stearyltrimethylammonium chloride, stearyldimethylethylammonium ethylsulfate, stearyltrimethylammonium methylsulfate, dilauryldimethylammonium methylsulfate, distearyldimethylammonium chloride, behenyltrimethylammonium chloride, stearyldimethylhydroxyethylammonium methylsulfate and lauryldimethylethylammonium ethylsulfate.

3. A detergent composition for dry cleaning as claimed in claim 1 wherein in the quaternary ammonium salt of the formula (1), $R_2$, $R_3$ and $R_4$ are each alkyl having 1 to 3 carbon atoms.

4. A detergent composition for dry cleaning as claimed in claim 1 wherein the anionic surfactant alkanolamine salt is an alkanolamine salt of an alkyl sulfate formula (2).

5. A detergent composition for dry cleaning as claimed in claim 1 wherein the anionic surfactant alkanolamine salt is an alkanolamine salt of an alkyl benzene-sulfonate of formula.

6. A detergent composition for dry cleaning as claimed in claim 1 wherein X is halogen.

7. A detergent composition as claimed in claim 6 wherein X is chlorine.

8. A detergent composition as claimed in claim 1 wherein the component (C) is tetrachloroethylene.

9. A detergent composition as claimed in claim 1 wherein said alkanolamine is selected from the group consisting of diethanolamine, triethanolamine, dibutylethanolamine and methyldiethanolamine.

10. A detergent composition as claimed in claim 1 in which the weight ratio of component (A) to component (B) is 100/10 to 100/40.

* * * * *

UNITED STATES PATENT AND TRADEMARK OFFICE

CERTIFICATE OF CORRECTION

PATENT NO. : 4 267 077

DATED : May 12, 1981

INVENTOR(S) : Yukihisa Niimi et al

It is certified that error appears in the above—identified patent and that said Letters Patent is hereby corrected as shown below:

Column 8, line 51; after "sulfate" insert ---of---.

Column 8, line 55; after "formula" insert ---(3)---.

Signed and Sealed this

Tenth Day of November 1981

[SEAL]

*Attest:*

GERALD J. MOSSINGHOFF

*Attesting Officer*

*Commissioner of Patents and Trademarks*